United States Patent [19]

Donnell et al.

[11] Patent Number: 4,746,096

[45] Date of Patent: May 24, 1988

[54] APPARATUS FOR DRIVING AN ELONGATE MEMBER THROUGH THE GROUND

[76] Inventors: David A. Donnell, P.O. Box 768, Winnsboro, La. 71295; Robert F. Holden, P.O. Box 5315, Longview, Tex. 75608

[21] Appl. No.: 926,972

[22] Filed: Nov. 4, 1986

[51] Int. Cl.[4] ..... E21B 19/00

[52] U.S. Cl. ..... 254/29 R; 254/108

[58] Field of Search ..... 254/29 R, 30, 31, 105, 254/108, 106; 294/92; 226/158, 162, 167

[56] References Cited

U.S. PATENT DOCUMENTS

| | | | |
|---|---|---|---|
| 2,080,104 | 5/1937 | Abramson et al. | 254/29 R |
| 2,742,258 | 4/1956 | Rosasco | 254/29 R |
| 4,368,873 | 1/1983 | Perry | 254/29 R |
| 4,434,969 | 3/1984 | Von Ruden | 254/29 R |

*Primary Examiner*—Robert C. Watson

*Attorney, Agent, or Firm*—Pravel, Gambrell, Hewitt, Kimball & Krieger

[57] ABSTRACT

An improved method and apparatus is disclosed for advancing a rod or pipe through the ground using a compressive force. The invention includes the use of a displaceable tray supported within a frame assembly for carrying a rod or pipe segment. A driving mechanism is included which is supported within the assembly and parallel and adjacent the rod or pipe segment to be driven. Using a removeable end plate insertable within the tray, the rod or pipe segment may be sequentially advanced in a stepwise fashion with a minimal size driving mechanism and frame assembly. Using a jaw assembly mounted on an end of the tray, the rod may be sequentially withdrawn in a stepwise fashion also.

22 Claims, 4 Drawing Sheets

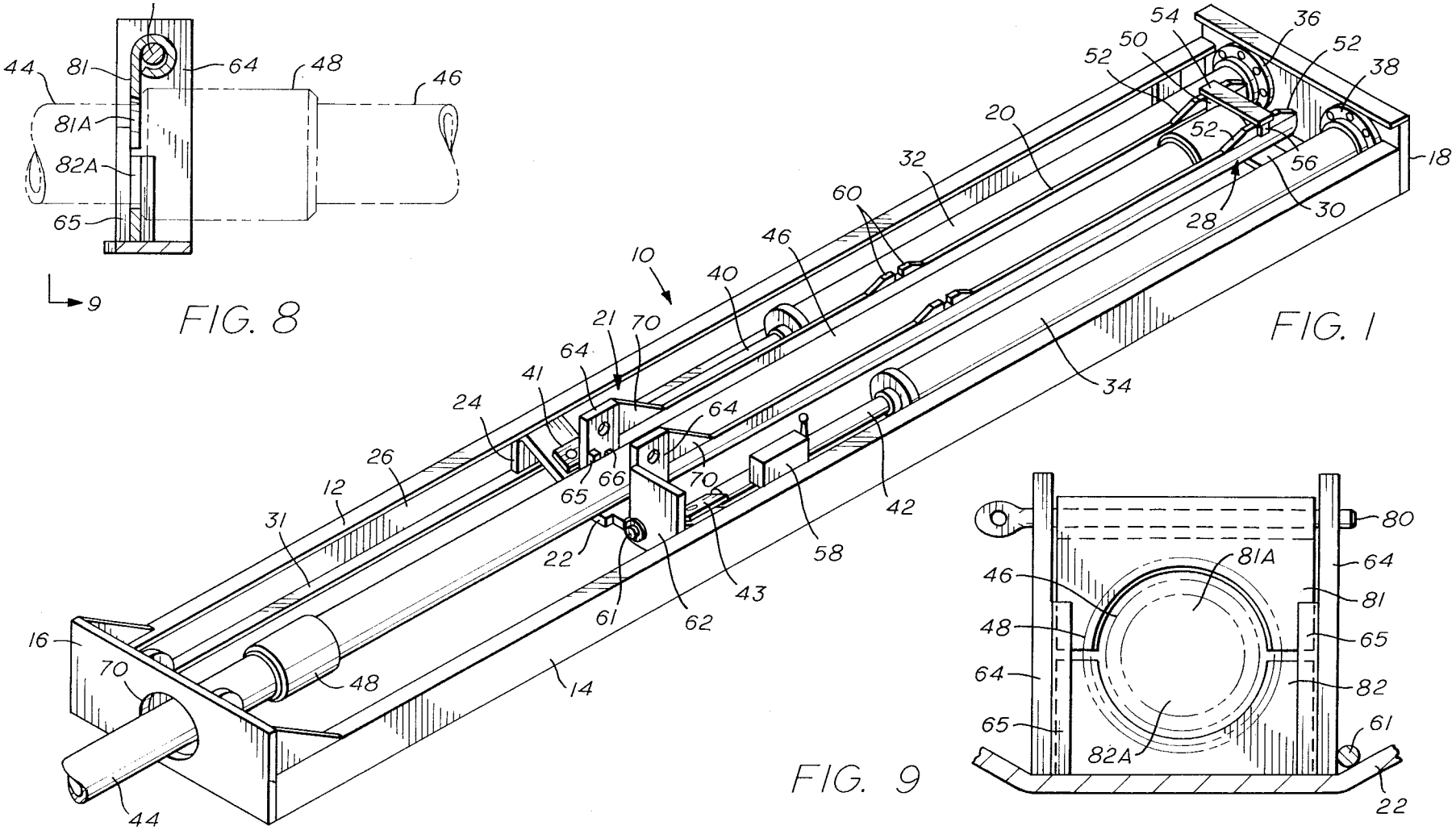
FIG. 1
FIG. 9
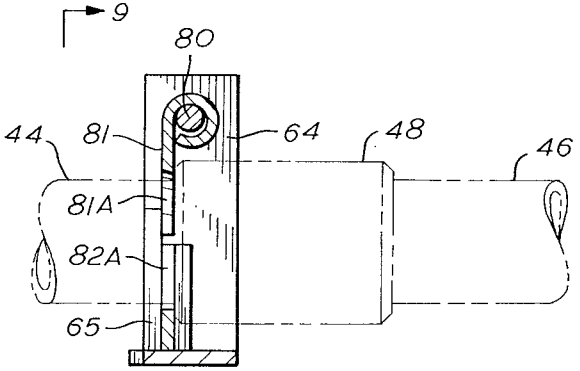
FIG. 8

APPARATUS FOR DRIVING AN ELONGATE MEMBER THROUGH THE GROUND

BACKGROUND OF THE INVENTION

1. Field of the Invention

This invention relates to a method and apparatus for driving an elongate member through the ground. More particularly, this invention relates to a method and apparatus for driving rod and pipe under embankments, roadways and the like using a driving mechanism which forces the pipe or rods through.

2. Description of the Prior Art

In the installation of pipelines, it is frequently necessary to install pipelines under roadways, driveways, embankments, or similar obstructions. Traditionally, a pipeline is installed under such obstructions by excavating a trench, lowering the pipeline in place and refilling the trench. However, this is not the preferred technique because it interferes with traffic in the case of a roadway, for example. Furthermore, digging trenches is expensive and time consuming. An alternative approach has been the use of conventional water or air drilling methods which use a rotary bit. Using these methods, a tunnel is excavated under the roadway or embankment prior to the installation of the pipeline. Again, this can be expensive, particularly in the case of larger pipelines because of the diameter of the tunnel required to accommodate the pipeline. Furthermore, the removal of the soil and other debris from both sides of the roadway or embankment as the tunnel is dug causes logistical problems, particularly if the trench dug to accommodate the drilling apparatus fills up.

A more satisfactory approach has been the use of compressive pipe pushing apparatus which force the pipe under the roadway or embankment. This is especially advantageous because it does not require a trench across the roadway which interferes with the traffic or the need to pre-drill a passageway or tunnel. However, even using pipe pushing apparatus there are disadvantages. For example, the prior art apparatus require a long trench to accommodate the frame assembly because the driving mechanism, which is usually hydraulic cylinders, is positioned behind the pipe segment to be driven. For example, U.S. Pat. No. 3,711,067 discloses a pipe pushing apparatus which uses a hydraulic cylinder 30 positioned behind the pipe segment 44 for moving pipe in a stepwise fashion. This motion is provided by a segment plate 9 advanced between frame members 1/2. U.S. Pat. Nos. 3,726,506 and 3,834,668 disclose other forms of pipe pushing apparatus. Again, in both of these references, the hydraulic cylinders are located behind the pipe segment being driven and the apparatus includes a fairly complicated gripping structure to engage the pipe prior to displacement. See also U.S. Pat. Nos. 4,020,641; 4,251,058; 4,299,375; 4,434,969; and 4,502,665.

U.S. Pat. Nos. 4,159,819; 4,082,248; and 3,358,966 disclose other types of apparatus used to drive larger diameter pipe primarily for roof support in larger tunnels such as railway or subway tunnels. U.S. Pat. No. 4,159,819 describes a pipe pushing apparatus having dual hydraulic cylinders 16 which push against tension members 18. Using clamping devices 22, the pistons advance the tension members forward which advance a collar 15 that pushes against the end of pipe 11. When the hydraulic cylinders are fully extended, the clamping devices are relocated on the tension members permitting another full extension of the hydraulic cylinders. U.S. Pat. No. 4,082,248 discloses an internally mounted pipe pushing apparatus which stations itself within the pipe to be driven. Hydraulic rams 11 engage on abutment means 17 advancing the pipe 12 forward. Once fully extended, a second section of pipe 12A is added, and the apparatus is retracted into the new section and reengaged. The process is repeated. U.S. Pat. No. 3,358,966 discloses an apparatus having pairs of rails 14 and 15 located circumferentially around a pipe 13. Hydraulic cylinders 17 push against these rails and against the ends of the pipe to advance the pipe through the ground. The pipe is advanced in a stepwise manner along the rails using keys 18 inserted in holes 19. See also U.S. Pat. No. 4,576,514.

However, the need exists for an improved pipe pushing apparatus and method for installing small diameter pipe. More particularly, the need exists for an apparatus which is only slightly longer in length than a segment of pipe but includes the capability of installing one or multiple pipe segments simultaneously using hydraulic cylinders small enough in size not to appreciably affect the overall size of the apparatus.

SUMMARY OF THE INVENTION

The present invention is directed to a method and apparatus for installing a segment of rod or pipe under a roadway or embankment using compressive force but occupying a minimal amount of space.

The apparatus includes a driving means mounted within and substantially parallel with the longitudinal axis of the frame assembly thereby shortening the length of the apparatus. Furthermore, the apparatus includes a moveable end plate and a rotatable end plate permitting a series of stroking operations for each pipe section thereby reducing the size of the driving mechanism required to install a particular size pipe. To accommodate a stepwise motion of the installation, the apparatus includes a displaceable tray assembly to support the pipe. Furthermore, because of the leverage achievable with stepwise movement using a tray displaceable relative to the frame assembly, smaller hydraulic cylinders can be used.

The method includes supporting a portion of a pipe segment on a displaceable tray and advancing that pipe segment into the ground using an end bearing member. Following the initial stroke of the driving mechanism, the tray is retracted and the end plate relocated to a second position. The driving mechanism is again activated and the tray advanced thereby advancing the pipe segment the full length of the cylinder stroke. The tray may then be retracted and, if necessary, a rotatable end plate engaged and the process repeated. In this manner, a single pipe segment may be advanced any number of times. The number of advancements will be selected based upon the desirable stroking length of the driving mechanism and soil conditions. By reducing the stroking length, a smaller driving mechanism may be used. And, in particularly compact soil, better driving characteristics are achieved if smaller increments or steps are taken.

Examples of the more important features of this invention have been summarized rather broadly in order that the detailed description which follows may be better understood. There are, of course, additional features of the invention which will be described hereafter and which will also form the subject of the claims appended hereto.

BRIEF DESCRIPTION OF THE DRAWINGS

In order to more fully understand the drawings used in the detailed description of the present invention, a brief description of each drawing is provided.

FIG. 1 is an isometric view of the present invention with a pipe segment installed and the apparatus in the first position.

FIG. 8 is a side elevation view of a jaw assembly used to retract rod or pipe.

FIG. 9 is a front elevation view of the jaw assembly.

DETAILED DESCRIPTION OF THE INVENTION

Figures 2, 3:
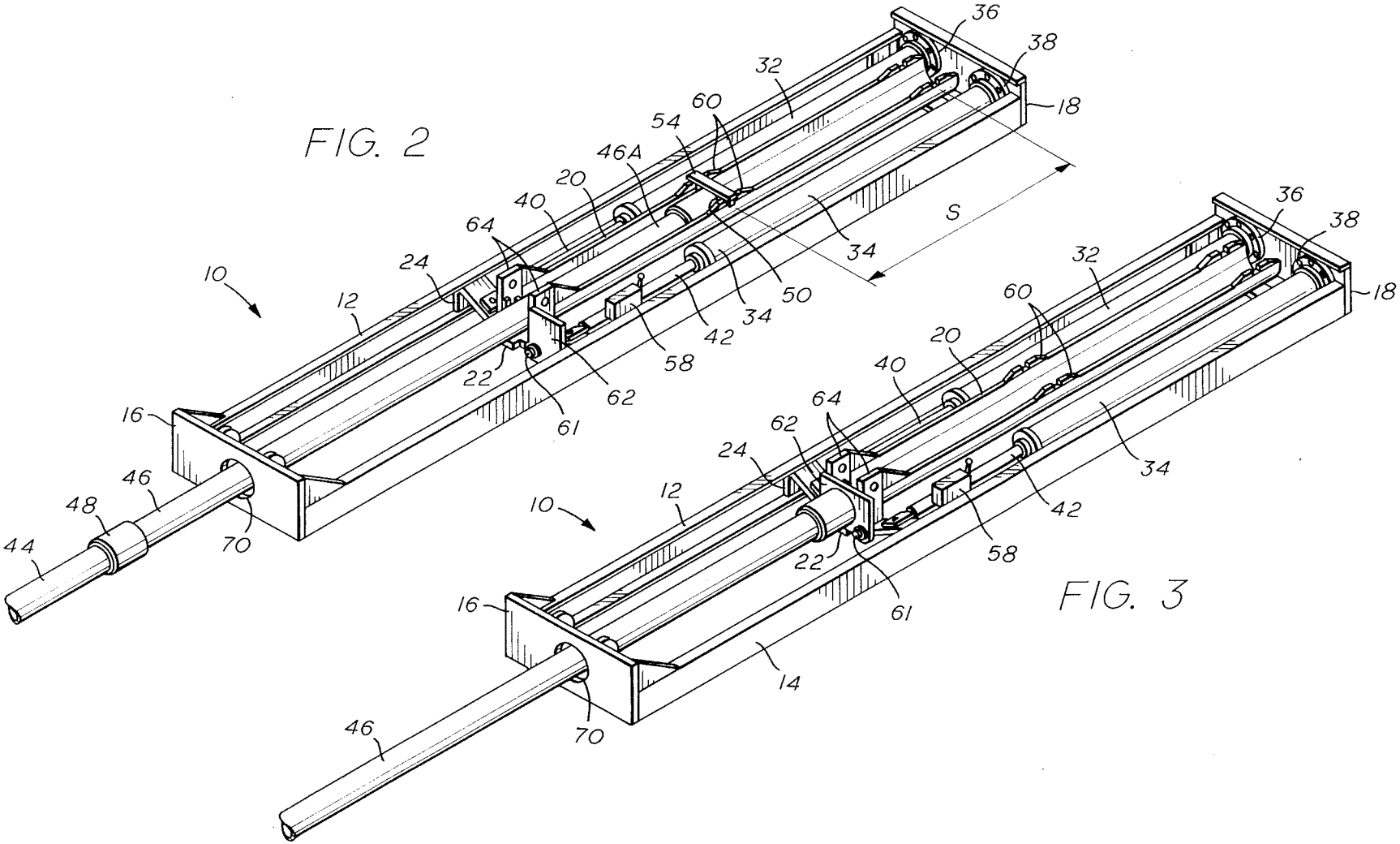
FIG. 2 is an isometric view of the present invention with a pipe segment partially advanced and the apparatus in the second position.
FIG. 3 is an isometric view of the present invention with a pipe segment further advanced and the apparatus in the third position.

Referring to FIG. 1, a frame assembly 10 is illustrated having longitudinal support members 12, 14 substantially parallel to one another. A front plate 16 connects to one end of each support member. Similarly, a rear plate 18 connects to the other end of each support member. Supported within the frame assembly is a tray 20. One end 21 of the tray is attached to a cradle bar 22 which includes vertical legs 24. Only one leg is shown in FIG. 1. There is another leg identical to leg 24 which rides within support member 14. These legs are sized to slide within the channel portion 26 of each support member. The other end 28 of the tray is attached to a rear support member 30 which slides along the lower flange 31 of the support members. Two hydraulic cylinders 32, 34 are shown anchored at one end 36, 38 to the rear plate 18. The ram 40, 42 of each cylinder is attached through a plate/pin arrangement 41, 43 to the cradle bar 22. The selection of the particular size hydraulic cylinder needed and its installation will be obvious to one skilled in the art based on this disclosure. For example, a typical cylinder used is double acting, has a 39 inch travel with a 2½ inch ram. One hydraulic cylinder may be used but the frame assembly will have to be stiffened to accommodate eccentric loading if the hydraulic cylinder is off the center line of the assembly.

Still referring to FIG. 1, a pipe segment 44 is shown advanced into the embankment (not shown). Pipe segment 46 has been lowered within the tray and threadably engaged with pipe segment 44 as represented by the coupling 48. Welded joints may also be used without affecting the operation of the apparatus. A moveable end plate 50 has been inserted within the tray and is held in a vertical position by gusset plates 52 which are attached to the top of the tray. As shown, the end plate includes a horizontal bar 54 to provide further support for the end plate. A portion 56 of the end plate extends past the gusset plates. This provides added rigidity to permit the introduction of a compressive force into the pipe segment once the hydraulic cylinders are activated and the rods extended. The cylinders are activated by a control unit 58 well known to those skilled in the art. Once activated, the tray is displaced to the left as shown in FIG. 1 thereby advancing pipe segments 44, 46 to the left.

The tray 20 includes additional gusset plates 60 which are similar to gusset plate 52 and serve to restrain the moveable end plate 50 when relocated as discussed below. The tray also includes a rotatable end plate 62 which pivots on a pin 61. The pin 61 is attached to the cradle bar 22. The front plate 16 occasionally may be referred to as the bank plate since it engages the bank or ground. The rear plate 18 occasionally may be referred to as the anchor plate or anchor end since it bears against the end of the trench and provides the abutment to exert a counteracting force to the horizontal force imposed by the hydraulic cylinders once activated. The front plate 16 includes an aperture 70 which is used to guide the pipe segments while being driven. Because of the large length to diameter ratio of the type of pipelines being driven by the invention, guidance by an aperture on the end plate is helpful and, at times, necessary in loosely compact soils.

The apparatus as shown in FIG. 1 is in a horizontal attitude located within a trench (not shown) perpendicular to the roadway or embankment and at the desired elevation of the pipeline.

Referring now to FIGS. 1, 8 and 9, the apparatus includes vertical plates 64 attached to the cradle bar 22. Plates 64 include apertures 68 and are braced by gusset plates 70 to the top of the tray. The plates 64 are designed to accommodate a jaw assembly as shown in FIGS. 8 and 9. The jaw assembly, which permits the gripping of a rod for its removal, includes an upper jaw 81, pivotly attached by a pin member 80 to plates 64, and a lower jaw 82. Upper jaws 81 include an open semicircular area 81A. Lower jaw 82 includes a similar open semicircular area 82A. The diameters of semicircular area 81A and 82A are selected slightly smaller than the diameter of collars which are added around the rod to be removed. The jaw assembly also includes bars 65 and 66 which are attached to plates 64 and serve to restrain lower jaw 82 from horizontal movement and upper jaw 81 from pivotal movement in one direction only.

Referring now to FIGS. 1, 2 and 3, the operation of the apparatus shall be discussed. Following activation of the hydraulic cylinders 32, 34 and the advancement of the tray for a distance "S" corresponding to the stroking distance of the cylinder selected by the operator, the cylinder is retracted and the tray returned to its original position. At that point, the end 46A of pipe segment 46 is immediately in front of the gusset plates 60. The stroking distance "S" of the cylinders selected by the operator is the same as the distance "S" between the gusset plates. This thereby permits the insertion of the moveable end plate 50 within the gusset plates 60 immediately against the end 46A of the pipe segment 46 as shown in FIG. 2. At that point, the hydraulic cyinders are activated and the tray again advanced to the left as shown in FIG. 2. Following another stroking distance "S" of the cylinders, the cylinders are again retracted and the tray returned to the original position as shown in FIG. 3. At that point, the end 46A of the pipe segment has advanced to a position immediately before the rotatable end plate 62. The rotatable end plate 62 is then rotated into position against vertical plates 64 and the process repeated for a third time. Once stroked the third time, the pipe segment has advanced sufficiently far to the left so that upon retraction of the tray to the far right, there is adequate space for the introduction of the next pipe segment, and the entire process is repeated. If the pipe segment to be pushed is too long to be completely inserted in three steps, a spacer (not shown) can be used to push the pipe further, allowing placement of the next segment of pipe in the apparatus. For instance, if cylinders with 39 inch travel are used to push 10½ foot segments of pipe, a spacer approximately one foot long must be used to fully insert the segment.

Obviously, the invention may be practiced with only two movements rather than three. In that event, the distance "S" of the cylinder is selected to correspond with the distance between the gusset plate and the rotatable end plate or the distance between two sets of gusset plates so that upon completion of two strokes the pipe segment has been advanced sufficiently far to permit the installation of the next pipe segment in the tray.

In the operation of the jaw assembly as shown in FIGS. 8 and 9, the jaw assembly is lowered onto the tray between bars 65 and 66. Bars 66 are identical to bars 65 except shorter, to allow the upper jaw 81 to swing in one direction, and held in position by the pin member 80. As mentioned above, the jaw assembly is used when it is desirable to withdraw a segment or segments of rod. A typical rod segment used with this apparatus is 2 inches in diameter, 5 feet long, and it has collars welded on at 14 inch intervals. The rod is inserted within the jaw assembly member and the cylinders stroked as the tray moves to the right as shown in FIG. 1. Because of upper and lower jaws 81, 82, the jaw assembly engages a collar on the rod segment tighter as more tensile force is introduced on the rod segment. Once the cylinder has stroked the distance "S", the tray may be advanced to the left as shown in FIG. 1. When this occurs, the jaws 81 and 82 release the rod segment permitting the advancement of the tray. Once the rams are fully extended, the hydraulic cylinders are activated retracting the tray to the right again engaging the jaws 81, 82 around another collar on the rod segment and permitting the introduction of a tensile force which further continues to pull the rod to the right. This process is repeated a sufficient number of times to withdraw a rod segment to the position shown in FIG. 1. At that time, the first rod segment is unscrewed from the second rod segment and the first rod segment is removed. The process is then repeated a sufficient number of times to withdraw the number of desired rod segments. Even though the jaw assembly described is designed for pulling on a rod, a jaw assembly with larger open semicircular areas 81A and 82A could be used to pull on a pipe if the pipe has a similar collar to engage the jaws 81 and 82, and if the distance between such collars is no greater than the stroking length of the cylinders. The advantage of pulling on the collars instead of using a pinching action is that the rod is not scarred.

An alternate method of using the apparatus as shown in FIGS. 1, 8 and 9 is to push a rod, in the stepwise fashion described above, through the embankment or under the roadway to a trench on the other side. This creates a pilot hole. Pipe segments are then attached to the end of the rod in the trench on the other side of the roadway, and the rod and pipe are pulled back through the embankment in the stepwise fashion described above, using the jaw assembly. Alternatively, after the pilot hole is created, pipe segments can be attached to the rod at the apparatus described and pushed through the embankment behind the rod, using the pilot hole as a guide. The means of attaching the rod to the pipe is a threaded adapter not shown but the construction and use of which are obvious to one skilled in the art based on this disclosure. This alternate method, using a pilot hole, is desirable when the precise locations of the ends of the embankment penetration are critical because of nearby structures or when obstructions may be encountered. Once the pilot rod is pushed through the embankment, the pipe can be attached and pushed or pulled through without risking any dislocation of the penetrations or hitting any additional obstructions. If soil conditions make the pushing or pulling particularly difficult, one apparatus can be used in each trench on opposite sides of the roadway with one apparatus pushing on the pipe while the other apparatus pulls on the rod attached to the pipe.

Figure 4:
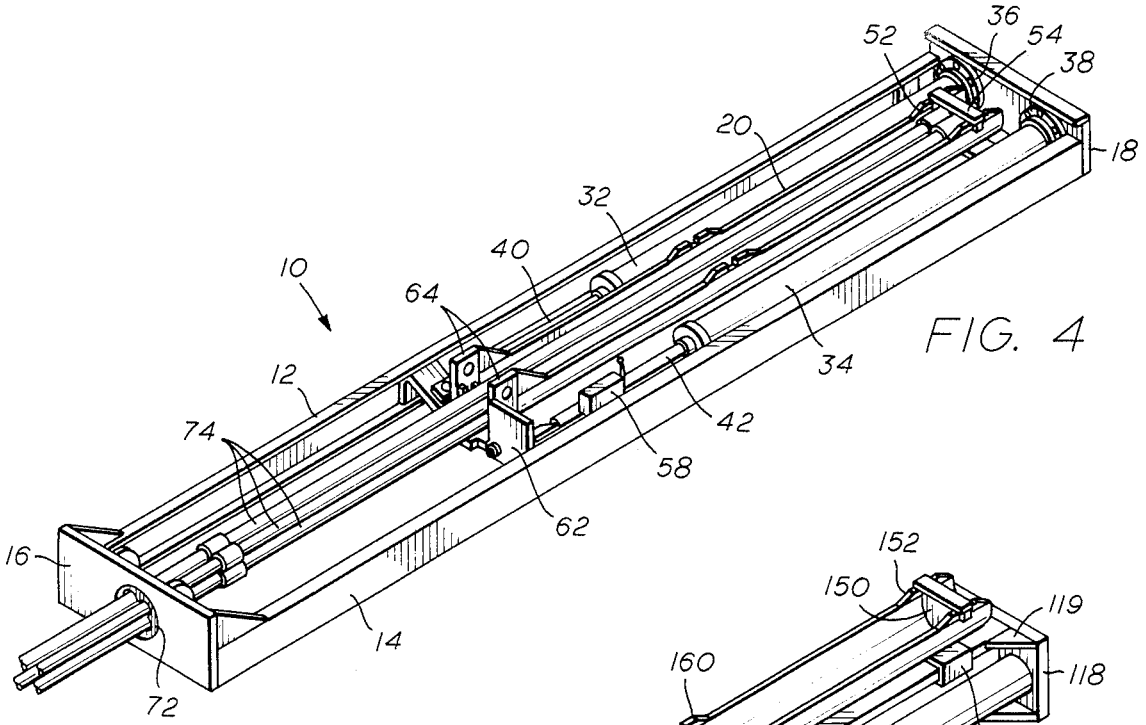
FIG. 4 is an isometric view of the present invention with multiple pipe sections shown and the apparatus in the first position.

Referring now to FIG. 4, the frame assembly 10 previously described with reference to FIG. 1 is shown except that the aperture 70 on the end plate accommodates an insert 72 used to guide multiple pipelines 74 being driven simultaneously. Otherwise, the apparatus and its operation as shown in FIG. 4 are identical to that disclosed above with respect to FIGS. 1–3. For removal of pipe segments of the multiple pipelines as shown in FIG. 4, the jaw member described above may be used. Its operation is identical to that described above with respect to a single pipeline but the semicircular areas 81A and 82A would be chosen to accommodate the configuration of the multiple pipes.

Figure 5:
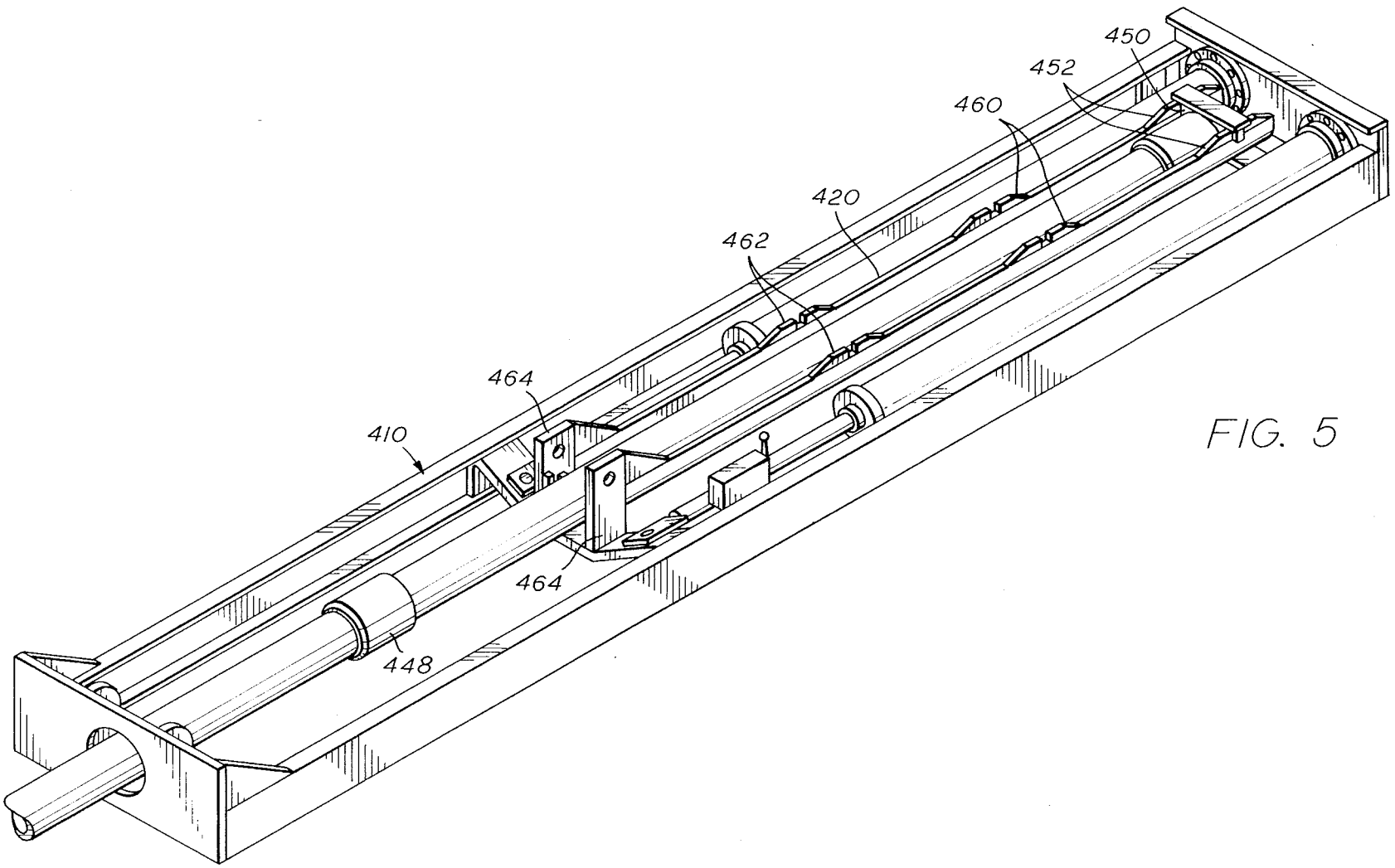
FIG. 5 is an isometric view of an alternate embodiment of the present invention.

Referring now to FIG. 5, an alternate embodiment of the present invention is shown which is similar to the preferred embodiment in FIG. 1 except that this alternate embodiment has three sets of gusset plates instead of two and it has no rotatable end plate. Moveable end plate 450 is positioned in gusset plates 452 for the first pushing step after which the cylinders are retraced and the moveable plate 450 is moved to gusset plates 460 for the second push and then, similarly, on to gusset plates 462 for the third push. Since gusset plates 462 are not located at the end of the tray next to vertical plates 464, a longer tray 420 and a longer frame assembly 410 will be required in order to insert a given length of pipe than would be required with the preferred embodiment. In all other respects, this alternate embodiment is identical to the preferred embodiment of FIG. 1. This alternate embodiment may be particularly desirable where extra trench length is not expensive, such as in loose soil, or where the apparatus can lie atop the grade for pushing pipe into an embankment. An advantage exhibited by this alternate embodiment is that the pipe or rod being pushed is always supported vertically and restrained horizontally for a portion of its length near the end being pushed, thereby reducing the transverse loads which could damage the coupling 448. This advantage may be important when the rod or pipe is of small diameter and when the soil is loose or when large rocks are encountered.

Figure 6:
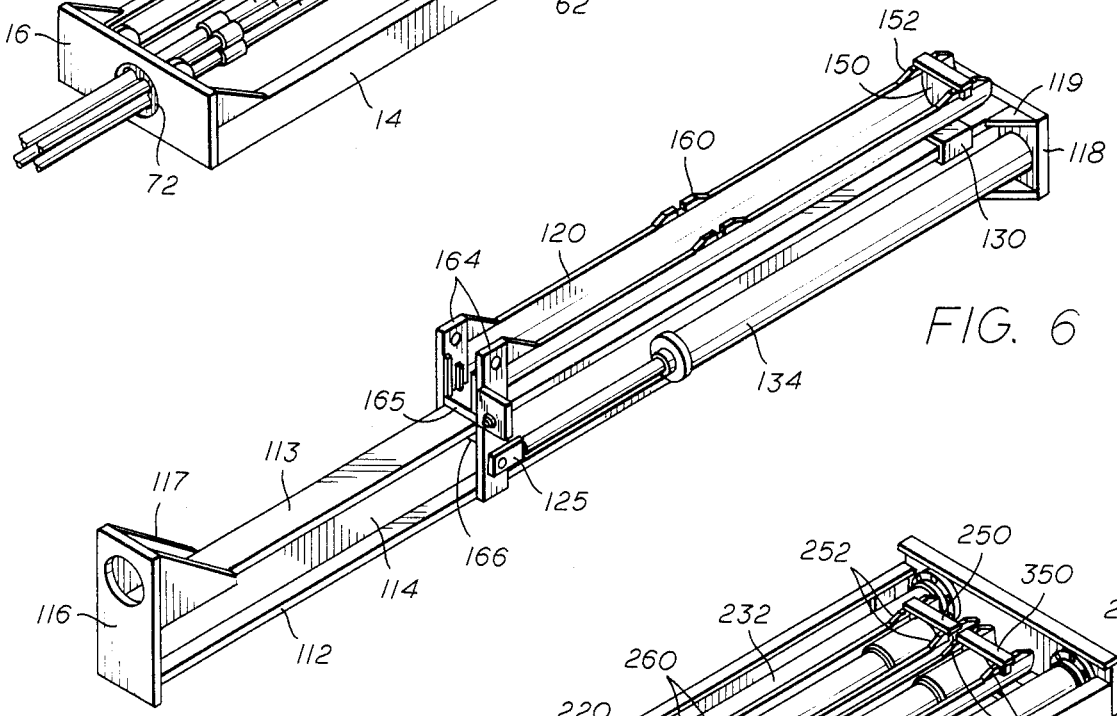
FIG. 6 is an isometric view of a second alternate embodiment of the present invention.

Referring now to FIG. 6, a second alternate embodiment of the present invention is shown which includes a single support member 112 having a front plate 116 attached to gusset members 117. A rear plate 118 is attached to the other end of the support member. Gusset plates 119 may be used to stiffen the rear plate. This alternate embodiment includes a tray 120 supported at one end by vertical members 164 having a horizontal bar 165 which rides above the top flange 113 of the support member. Horizontal bars 166 are attached to each vertical member 164 immediately below the flange 113. Horizontal bars 166 do not penetrate the web 114 of the support member 112. Rather they terminate at the web and provide vertical stability. The members 164, and horizontal bars 165, 166 provide for an assembly to vertically support one end of the tray yet permit longitudinal displacement of the tray relative to the support member. The other end of the tray is supported on a channel member 130 designed to fit around the top flange 113 of the support member. In this manner, the rear end of the tray is also vertically supported yet displaceable along the longitudinal axis of the support member. This alternate embodiment also includes two hydraulic cylinders 134 (only one is shown because of the isometric view), having one end attached to the end plate 118 and the other end attached through a plate/-pin arrangement 125 to the vertical members 164.

The operation of the alternate embodiment shown in FIG. 6 is similar to the preferred embodiment discussed above with respect to FIG. 1. The tray 120 includes two sets of gusset plates 152, 160 to accommodate a moveable end plate 150 and a rotatable end plate 162. The operation comprises a stepwise movement of the tray permitting the insertion of the moveable end plate in each set of gusset plates and rotation of the rotatable end plate as the pipe segment is advanced.

Figure 7:
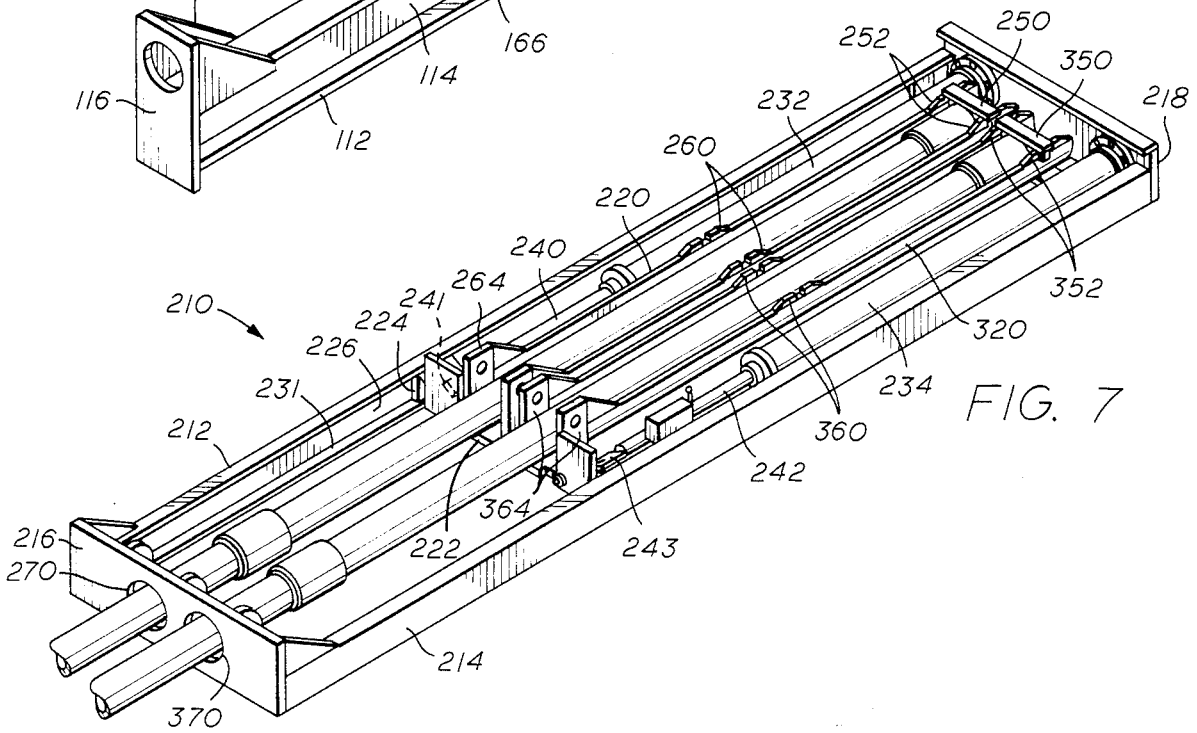
FIG. 7 is an isometric view of a third alternate embodiment of the present invention.

Referring now to FIG. 7, a third alternate embodiment of the present invention is shown. The frame assembly 210 is generally similar to that discussed above with respect to FIG. 1. That is, the frame 210 includes two support members 212, 214 connected by front and rear plates 216, 218. However, in this alternate embodiment two trays 220, 320 are shown. The front end of each tray is supported by a cradle bar 222 having vertical legs 224 which slide within the channel portion 226 of each support member 212, 214. The other end of the tray is supported by a rear support member 230 which slides along the lower flange 231 of the support members 212, 214. Again, this alternate embodiment includes hydraulic cylinders 232, 234 attached at one end to the rear plate 21B. The ram 240, 242 of each cylinder is attached through a plate/pin arrangement 241, 243 to the cradle bar 222. Each tray includes gusset plates 252, 260, 352, 360 to accommodate a moveable end plate 250, 350. Two moveable end plates are shown; however, one end plate may be used which transverses both trays. Each tray also includes a rotatable end plate 262, 362 to provide a third step in applying force to the pipe ends. This alternate embodiment permits the simultaneous insertion of two pipe segments on parallel pipelines. In this alternate embodiment, the operation is identical to that described shown above with respect to FIG. 1 except that two pipe segments are being installed and two moveable end plates are being positioned following the stroking of each cylinder. Obviously, one cylinder may be used sufficiently sized to exert the needed compressive force for advancing both trays holding two pipe segments. The one cylinder would preferably be located between the two trays to eliminate an eccentric loading. Furthermore, this alternate embodiment may be used to install only one pipeline, if desirable, or it may be desirable to install multiple lines in one tray and a single line in the other, or multiple lines in both trays, or some variation thereof. Under these circumstances, guide inserts (not shown but similar to insert 72 in FIG. 4) would be installed within apertures 270, 370 on the front plate 216. Then inserts would be sized to accommodate the particular configuration of the multiple pipelines being driven. One insert may be designed to accommodate four pipes as shown in FIG. 4 and discussed above while the other insert may accommodate a single pipe. Alternatively, one insert may accommodate four pipes while the other accommodates two or three or some other number.

Furthermore, for fabrication reasons, it may be desirable to have an insert which fits within the aperture to accommodate a single as well as multiple pipelines. For example, if a 4-inch line is being installed the aperture may be 6 inches in diameter and an insert used having an inner diameter slightly more than 4 inches to provide a snug guide for the pipeline. When multiple pipelines are to be driven, the first insert may be removed and another insert installed which has the particular pattern or configuration of the multiple lines as shown in FIG. 4. Such inserts may be used in the aperture of the front plate of any of the embodiments shown.

Referring to FIGS. 5, 6, and 7, the embodiments include vertical members 164, 264, 364, 464 having apertures adapted to accommodate the pin member 80 of jaw assembly as shown in FIGS. 8 and 9. Such a jaw assembly is identical to that discussed above with respect to FIGS. 8 and 9 and would operate in the same manner. This would thereby permit the removal of a pipe or rod using the alternate embodiments shown in FIGS. 5, 6 or 7.

Even though the description of the present invention has been made in terms of a pipe, the operation can be performed in a similar manner if a rod is installed. There is no need for a change in any of the embodiments shown to accommodate a rod.

By using a moveable end plate in a stepwise fashion in combination with a displaceable tray, smaller cylinders may be used. This is possible because of the combination effect which a displaceable tray provides coupled with its segmented advancement. Further, by mounting the cylinders within the assembly and adjacent the tray, the length of the apparatus is reduced. This substantially reduces the length of a trench to accommodate the apparatus.

Many obvious variations and modifications are possible to one skilled in the art in view of this disclosure. For example, the cylinders may be mounted to an intermediate support structure which in turn is attached to the end plate. This would further reduce the overall length of the cylinders and may permit the use of even smaller cylinders. Many modifications and alterations to these embodiments will be apparent to those skilled in the art in view of this disclosure. It is, therefore, intended that all such equivalent modifications and variations fall within the spirit and scope of the present invention as claimed.

What is claimed is:

1. An apparatus for driving an elongate member through the ground comprising:

a frame assembly having at least one longitudinal support member, a first end member attached to one end of said support member in the direction said elongate member is driven, and a second end member attached to the other end of said support member;

a tray substantially parallel to and engaging said support member and adapted to support a portion of said elongate member, said tray being capable of longitudinal displacement within said assembly and having first and second ends, said first end of said tray being proximal said first end member and said second end being distal said first end member;

a moveable end plate adapted to contact one end of said elongate member and capable of being inserted within said tray in a first position proximate said second end of said tray and in a second position intermediate said first position and said first end of said tray; and means for displacing said tray longitudinally within said assembly.

2. The apparatus according to claim 1 wherein said apparatus further comprises plate means proximate said first end of said tray adapted to contact one end of said elongate member.

3. The apparatus according to claim 1 wherein said moveable end plate is capable of being inserted in a third position intermediate said second position and said first end of said tray.

4. The apparatus according to claim 1 wherein said drive means comprises at least one hydraulic cylinder positioned within said assembly and substantially parallel to said support member, said cylinder having one end attached to said assembly proximate said second end member and having its other end attached to said tray proximate said first end of said tray.

5. The apparatus according to claim 4 wherein said first end member includes an aperture for guiding said elongate member.

6. The apparatus according to claim 1 wherein said tray is adapted to support a portion of at least two elongate members.

7. The apparatus according to claim 1 wherein said apparatus further comprises a means for engaging said elongate member to permit the withdrawal of said elongate member from the ground.

8. The apparatus according to claim 7 wherein said engaging means for removal of said elongate member comprises a first jaw member and a second jaw member attached to said first end of said tray and adapted to engage around said elongate member.

9. An apparatus for driving an elongate member through the ground comprising:

a frame assembly having at least one longitudinal support member, a first end member attached to one end of said support member in the direction said elongate member is driven and having an aperture for guiding said elongate member, and a second end member attached to the other end of said support member;

a tray substantially parallel to and engaging said support member and adapted to support a portion of said elongate member, said tray being capable of longitudinal displacement within said assembly and having first and second ends, said first end of said tray being proximal said first end member and said second end of said tray being distal said first end member;

a first end plate mounted within said tray and adapted to contact one end of said elongate member;

a second end plate pivotally attached to said first end of said tray and adapted to rotate from a first position wherein said second end plate permits the support of a portion of said elongate in said tray and a second position wherein said second end plate is adapted to contact one end of said elongate member; and means for displacing said tray longitudinally within said assembly.

10. An apparatus for driving an elongate member through the ground comprising:

a frame assembly having at least one longitudinal support member, a first end member attached to one end of said support member in the direction said elongate member is driven and having an aperture for guiding said elongate member, and a second end member attached to the other end of said support member;

a tray substantially parallel to and engaging said support member and adapted to support a portion of said elongate member, said tray being capable of longitudinal displacement within said assembly and having first and second ends, said first end of said tray being proximal said first end member and said second end of said tray being distal said first end member;

a moveable end plate adapted to contact one end of said elongate member and capable of being inserted within said tray in a first position proximate said second end of said tray and in a second position intermediate said first position and said first end of said tray; and at least one hydraulic cylinder for displacing said tray longitudinally within said assembly wherein said cylinder is positioned within said assembly and substantially parallel to said support member having one end attached to said assembly proximate said second end member and having its other end attached to said tray proximate said first end of said tray.

11. The apparatus according to claim 10 wherein said moveable end plate is capable of being inserted in a third position intermediate said second position and said first end of said tray.

12. An apparatus for driving at least one elongate member through the ground comprising:

a frame assembly having two substantially parallel longitudinal support members, a first end member attached at each of its ends to that end of each said support members in the direction said elongate member is driven, and a second end member attached at each of its ends to the other end of each said support members;

a tray positioned intermediate said support members and engaging said support members, adapted to support a portion of said elongate member, said tray being capable of longitudinal displacement substantially parallel to said support members and having first and second ends, said first end of said tray being proximal said first end member and said second end being distal said first end member;

a moveable end plate adapted to contact one end of said elongate member and capable of being inserted within said tray in a first position proximate said second end of said tray and in a second position intermediate said first position and said first end of said tray;

a rotatable end plate pivotally attached to said first end of said tray and adapted to rotate from a first position wherein said rotatable end plate permits the support of a portion of said elongate member and a second position wherein said rotatable end plate is adapted to contact one end of said elongate member; and means for displacing said tray longitudinally within said assembly.

13. An apparatus for driving at least two elongate members through the ground comprising:

a frame assembly having two substantially parallel longitudinal support members, a first end member attached at each of its ends to that end of each said support members in the direction said elongate members are driven and having an aperture for guiding said elongate members, and a second end member attached at each of its ends to the other end of each said support members;

a tray substantially parallel to and positioned intermediate said support members, said tray engaging said support members and adapted to support a portion of said elongate members, said tray being capable of longitudinal displacement within said assembly and having first and second ends, said first end of said tray being proximal said first end member and said second end being distal said first end member;

a moveable end plate adapted to engage one end of said elongate members and capable of being inserted within said tray in a first position proximate said second end of said tray and in a second position intermediate said first position and said first end of said tray; and means for displacing said tray longitudinally within said assembly.

14. An apparatus for driving at least two elongate members through the ground comprising:

a frame assembly having two substantially parallel longitudinal support members, a front end member attached at each of its ends to that end of each said support members in the direction said elongate members are driven, and a rear end member attached at each of its ends to the other end of each said support members;

a first tray substantially parallel to and positioned intermediate said support members, said first tray engaging at least one of said support members and adapted to support at least one elongate member, said first tray being capable of longitudinal displacement within said assembly and having first and second ends, said first end of said first tray being proximal said front end member and said second end being distal said front end member;

a second tray substantially parallel to and positioned intermediate said support members, said second tray engaging at least one of said support members and adapted to support at least one elongate member, said second tray being capable of longitudinal displacement within said assembly and having first and second ends, said first end of said second tray being proximal said front end member and said second end of said second tray being distal said front end member;

a first moveable plate adapted to engage one end of elongate member and capable of being inserted within said first tray in a first position proximate said second end of said first tray and in a second position intermediate said first position and said first end of said first tray;

a second moveable plate adapted to engage at least one end of another elongate member and capable of being inserted within said second tray in a first position proximate said second end of said second tray and in a second position intermediate said first position and said first end of said second tray; and means for displacing said first and second trays longitudinally within said assembly.

15. The apparatus according to claim 14 wherein said drive means comprises at least one hydraulic cylinder positioned within said assembly and substantially parallel to said support members, said cylinder having one end attached to said assembly proximate said rear end member and having its other end attached to said first and second trays proximate said first ends of said first and second trays.

16. The apparatus according to claim 15 wherein said front end member includes at least one aperture for guiding said elongate members.

17. An apparatus for driving an elongate member through the groung, comprising:

a frame assembly having at least one longitudinal support member, a first end member attached to one end of said support member in the direction said elongate member is driven, and a second end member attached to the other end of said support member;

a tray substantially parallel to and engaging said support member and adapted to support a portion of said elongate member, said tray being capable of longitudinal displacement within said assembly and having first and second ends, said first end of said tray being proximal said first end member and said second end being distal said first end member;

a movable end plate adapted to contact one end of said elongate member and capable of being inserted within said tray in a first position proximate said second end of said tray and in a second position intermediate said first position and said first end of said tray;

a rotatable plate pivotally attached to said first end of said tray and adapted to rotate from a first position wherein said rotatable plate permits the support of a portion of said elongate member in said tray and a second position wherein said rotatable end plate is adapted to contact one end of said elongate member; and means for displacing said tray longitudinally within said assembly.

18. An apparatus for driving elongate members through the ground, comprising:

a frame assembly having at least one longitudinal support member, a first end member attached to one end of said support member in the direction said elongate members are driven, and a second end member attached to the other end of said support member;

a first tray substantially parallel to and engaging said support member and adapted to support a portion of a first elongate member, said first tray being capable of longitudinal displacement within said assembly and having first and second ends, said first end of said first tray being proximal said first end member and said second end being distal said first end member;

a first movable end plate adapted to contact one end of said first elongate member and capable of being inserted within said first tray in a first position proximate said second end of said first tray and in a second position intermediate said first position and said first end of said first tray;

a second tray substantially parallel to and engaging said support member and adapted to support a portion of a second elongate member, said second tray being capable of longitudinal displacement within said assembly and having first and second ends, said first end of said second tray being proximal said first end member and said second end being distal said first end member;

a second moveable end plate adapted to engage one end of said second elongate member and capable of being inserted within said second tray in a first position proximate said second end of said second tray and in a second position intermediate said first position and said first end of said second tray; and means for displacing said first and second trays in synchronous movement longitudinally within said assembly.

19. The apparatus according to claim 18 wherein said apparatus further comprises:

a first rotatable end plate pivotally attached to said first end of said tray and adapted to rotate from a first position wherein said first rotatable end plate permits the support of a portion of said elongate member in said tray and a second position wherein said first rotatable end plate is adapted to contact one end of said elongate member; and a second rotatable end plate pivotally attached to said first end of said second tray and adapted to rotate from a first position wherein said second rotatable end plate permits the support of a portion of said second elongate member in said second tray and a second position wherein said second rotatable end plate is adapted to contact one end of said second elongate member.

20. The apparatus according to claim 18 wherein:

said moveable end plate is capable of being inserted in a third position intermediate said second position and said first end of said tray; and said second moveable end plate is capable of being inserted in a third position intermediate said second position and said first end of said second tray.

21. The apparatus according to claim 18 wherein said drive means comprises at least one hydraulic cylinder positioned within said assembly and substantially parallel to said support member, said cylinder having one end attached to said assembly proximate said second end member of said assembly and having its other end attached to said trays proximate said first ends of said trays.

22. The apparatus of claim 21 wherein said first end member includes an aperture for guiding said elongate members.

* * * * *